US006348263B1

(12) United States Patent
Hatano et al.

(10) Patent No.: US 6,348,263 B1
(45) Date of Patent: Feb. 19, 2002

(54) POLYPARAPHENYLENE TEREPHTHALAMIDE FIBER AND METHOD FOR PRODUCING THE SAME

(75) Inventors: Takeshi Hatano, Osaka; Shiro Sakamoto; Kazuhiko Kosuge, both of Tokyo, all of (JP)

(73) Assignee: DuPont-Toray Co., Ltd. (JP)

( * ) Notice: Subject to any disclaimer, the term of this patent is extended or adjusted under 35 U.S.C. 154(b) by 0 days.

(21) Appl. No.: 09/720,059

(22) PCT Filed: Apr. 26, 1999

(86) PCT No.: PCT/JP99/02195

§ 371 Date: Dec. 20, 2000

§ 102(e) Date: Dec. 20, 2000

(87) PCT Pub. No.: WO00/65135

PCT Pub. Date: Nov. 2, 2000

(51) Int. Cl.[7] ..... D01F 6/00; D01F 6/90

(52) U.S. Cl. ..... 428/364; 428/394; 428/395

(58) Field of Search ..... 428/364, 359, 428/395, 394

(56) References Cited

U.S. PATENT DOCUMENTS 6,001,474 A * 12/1999 Prickett et al. ..... 428/359

* cited by examiner

*Primary Examiner*—N. Edwards
(74) *Attorney, Agent, or Firm*—Schnader Harrison Segal & Lewis

(57) ABSTRACT

A dyeable polyparaphenylene terephthalamide fiber which has been wound once after spinning and has not been dyed yet, characterized in that it has a tensile strength of 15 g/denier or more and a crystal size (110 direction) of 30 to 55 angstroms and has no history of a treatment drying to have a water content of 8% or less, and a method for producing the same. A polyparaphenylene terephthalamide fiber which can be dyed while its properties of high strength and high modulus elasticity are maintained, and textile products made of the fiber which are dyed in a variety of colors, can be provided.

10 Claims, No Drawings

POLYPARAPHENYLENE TEREPHTHALAMIDE FIBER AND METHOD FOR PRODUCING THE SAME

TECHNICAL FIELD OF THE INVENTION

The present invention relates to para system aramide fiber and method for producing the same.

BACKGROUND ART OF THE INVENTION

Polyparaphenylene terephthalamide fiber (hereinafter, referred to as para system aramide fiber) is a synthetic fiber having high functions such as of high strength, high modulus elasticity, high thermal resistance, non-electro-conductivity, and no rust occurrence, as well as having flexibility and lightweight property, which are characteristics of organic fibers. From these properties, it is used as a reinforcement material for a tire for a motorcar, a motorcycle and a bicycle, a timing belt for a motorcar, a conveyer and the like. Further, it is also used for reinforcing an optical fiber cable, and as a rope. Furthermore, it is also applied to a bulletproof jacket, protection clothes which are formed as working gloves and working clothes by utilizing the feature being hard to be cut against an edged tool, and clothes for fire fighting formed by utilizing the feature being hard to burn.

In these applications, nevertheless a dyeable property is required in addition to the above-described properties, it has been difficult to dye aramide fiber, because of its high crystallinity, and its minute structure due to high intermolecular force.

The following methods have been proposed so far, as methods for dyeing aramide fibers.

JP-A-SHO 50-12322 proposes a method for diffusing additives such as dye, antioxidant, ultraviolet insulation agent, and fireproofing agent in a fiber expanded by water. However, JP-A-SHO 50-12322 does not describe with respect to diffusion of all kinds of dyes into fibers, and also does not specify the conditions. Especially, it does not describe dyeing under a condition of a water content of 50% or less.

JP-A-SHO 54-59476 discloses a method for dyeing from buckling portions of a fiber after providing crimps to the fiber at 10 crimps/inch or more. Further, JP-A-HEI 2-41414 discloses a method for adding an organic pigment to a dope for spinning. JP-A-SHO 63-145412 proposes a method for introducing para oriented aramide into a process, in which the tension is relaxed, at a coagulation step immediately after spinning, thereby bringing it into contact with a dyeing solution. Further, JP-A-HEI 7-258980 proposes a method for bringing para system aromatic polyamide, whose inherent viscosity is 2.5 dl/g or less and which is expanded by water, into contact with a dyeing solution. JP-A-HEI 8-260362 discloses a method for dyeing by a cation system dye at a temperature of 130° C. or higher, while using a fiber expansion agent. JP-A-HEI 5-209372 discloses a method for dyeing a copolymerized para system aramide fiber at a temperature of 160° C. or higher by using a dispersed dye having a molecular weight of 400 or less. Furthermore, JP-A-HEI 9-87978 and JP-A-HEI 9-87979 propose a method for dyeing a para system aramide fiber under a condition of a high pressure and a temperature of 200° C. after treating it with a polar solvent such as dimethylsulfoxide.

In the method of the above-described JP-A-SHO 54-59476, however, for a high-strength and rigid para system aramide fiber, it is difficult to provide crimps at 10 crimps/inch or more, and this method is restricted for a formation of a staple. The method disclosed in JP-A-HEI 2-41414 is a proposal for a so-called originally colored spinning, and the method described in JP-A-SHO 63-145412 is a method for bringing a fiber into contact with a dye solution at a tension-free condition without winding it after spinning. In any method, a fairly large volume of production per one color is required, and the color employed is limited. In the method disclosed in JP-A-HEI 7-258980, the strength of a fiber is extremely low because of a low viscosity of the polymer, and therefore, the method cannot satisfy the feature of high strength which aramide fiber essentially has. The method disclosed in JP-A-HEI 8-260362 is a proposal for a spun yarn, which is inferior to a filamentary yarn in tensile strength and tensile elastic modulus, and therefore, it is not satisfied as a method for dyeing a filament capable of utilizing the function of a high strength and a high elastic modulus of original aramide fiber. The methods disclosed in JP-A-HEI 5-209372, JP-A-HEI 9-87978 and JP-A-HEI 9-87979 are not common, because they require special equipment such as one for recovery of a polar solvent or for high-temperature dyeing.

So far, a method for post-dyeing capable of applying various colors at a form of a filament which can maintain the features of high-strength and high-elastic modulus of aramide fiber, namely, a method for dyeing various colors in a dyeing process, capable of dyeing at respective colors individually from each other, separately and after a process in which a spun filament is once wound onto a tube-like material, has not yet been realized.

A yarn forming process for forming a filamentary yarn and a dyeing process for dyeing the yarn generally are separated from each other, and the respective processes are performed by respective technical experts using respective exclusive equipment. To satisfy severe requirements of customers as to colors of dyed textile products, it is important to break off the process once after producing fibers, and to transport the fibers to a plant for dyeing and dye the fibers in respective colors, that customers require, by technical experts for dyeing.

DISCLOSURE OF THE INVENTION

Accordingly, it is an object of the present invention to provide a para system aramide fiber which can be dyed while its properties of high strength and high modulus elasticity can be maintained, and a para system aramide fiber dyed in various colors.

To accomplish this object, the present invention takes the following ways.

(1) A dyeable polyparaphenylene terephthalamide fiber which has been wound once after spinning and has not been dyed yet, characterized in that the fiber has a tensile strength of 15 g/denier or more and a crystal size (110 direction) of 30 to 55 angstroms and has no history of a treatment drying to have a water content of 8% or less.

(2) The dyeable polyparaphenylene terephthalamide fiber according to the above-described (1), wherein the fiber has no history of a treatment drying to have a water content of 15% or less.

(3) A staple type of dyeable polyparaphenylene terephthalamide fiber, wherein the fiber according to the above-described (1) or (2) is treated to be provided with 4 to 9 crimps/25 mm, and cut at a fiber length of 20 to 150 mm.

(4) A flock type of dyeable polyparaphenylene terephthalamide fiber, wherein the fiber according to the above-described (1) or (2) is cut at a length of 0.1 to 3 mm.

(5) A dyed polyparaphenylene terephthalamide fiber, wherein the fiber according to the above-described (1) or (2) is dyed.

(6) The dyed polyparaphenylene terephthalamide fiber according to the above-described (5), wherein the fiber is dyed by a cation dye.

(7) A staple type of dyed polyparaphenylene terephthalamide fiber, wherein the staple type of polyparaphenylene terephthalamide fiber according to the above-described (3) is dyed.

(8) The staple type of dyed polyparaphenylene terephthalamide fiber according to the above-described (7), wherein the fiber is dyed by a cation dye.

(9) A flock type of dyed polyparaphenylene terephthalamide fiber, wherein the flock type of polyparaphenylene terephthalamide fiber according to the above-described (4) is dyed.

(10) The flock type of dyed polyparaphenylene terephthalamide fiber according to the above-described (9), wherein the fiber is dyed by a cation dye.

(11) A method for producing a dyeable polyparaphenylene terephthalamide fiber by a filament forming step and a filament dyeing step, performed separately from each other, the filament forming step being performed by preparing a dope for spinning from polyparaphenylene terephthalamide having an inherent viscosity (η inh) of 5 or more and a concentrated sulphuric acid, once spinning the dope in air through fine holes of a spinning die, and immediately thereafter, introducing the spun dope into water to coagulate it to form a high-strength and high-modulus elasticity filament, characterized in that the fiber has a tensile strength of 15 g/denier or more and a crystal size (110 direction) of 30 to 55 angstroms, and a water content of the fiber is always maintained at 8% or more.

(12) A method for cheese-dyeing the dyeable polyparaphenylene terephthalamide fiber produced by the method according to the above-described (11) by using a cation dye at a condition of a number of twist defined by a coefficient of twist of 0.2 or less represented by the following equation.

$$K=(T\sqrt{D})/2870$$

K: coefficient of twist

T: number of twist (number/m)

D: fiber size in absolute dry condition (denier)

THE BEST MODE FOR CARRYING OUT THE INVENTION

A polyparaphenylene terephthalamide (hereinafter, also referred to as "PPTA") according to the present invention is a polymer obtained by polycondensation of terephthalic acid and paraphenylenediamine, and a small amount of dicarboxylic acid and diamine may be copolymerized. Polyparaphenylene terephthalamide fiber (hereinafter, referred to as "para system aramide fiber") according to the present invention is produced by making an optically anisotropic dope from PPTA having an inherent viscosity (η inh) of 5 or more and a concentrated sulphuric acid, once spinning the dope in air through fine holes of a spinning die, immediately thereafter, introducing the spun dope into water to coagulate it, introducing it into a Nelson roller and neutralizing it in a sodium hydroxide solution, slightly drying it by a hot roller after a water washing process, and passing it through a process for continuously winding it on a tube as a filament. Para system aramide fiber wound is wrapped by a wrapping material such as a polyethylene film so as to prevent it from being dried before being sent to a drying process. The crystallinity of the para system aramide fiber in this step is 50% or less. Although the tensile modulus elasticity of the fiber is over 400 g/denier and it has a feature as a high-modulus elasticity fiber, in order to further increase the modulus elasticity, the fiber is heat treated at a temperature of 350 to 400° C. for 5 to 10 seconds after drying, and by this treatment, the crystallinity is generally increased up to a degree over 50%.

The inherent viscosity (η inh) of PPTA used in the present invention is preferably 5 or more. If the inherent viscosity (η inh) is less than 5, it is hard to obtain the fiber properties of high strength and high modulus elasticity.

In the para system aramide fiber according to the present invention, it is necessary that the crystal size (110 direction) is in a range of 30 to 55 angstroms and the water content is always more than 8%. If the crystal size is less than 30 angstroms, it is difficult to sufficiently densify the fiber and to achieve the fiber properties of high strength and high modulus elasticity, and if the crystal size is more than 50 angstroms, it is difficult to dye.

Where, "the water content is always more than 8" means that it has no history of a treatment that has dried it at a water content of 8% or less. If the fiber is dried at a water content of 8% or less, the structure is too densified and it becomes hard to dye it. In such a condition, even if water is provided again, the dyeability cannot be recovered. Preferably, the water content of para system aramide fiber is in a range of,15 to 49%. If the water content is 50% or more, it is difficult to wind the fiber because the frictional resistance between the fiber and guide rolls and the like becomes great. To control such a preferable water content, it is desired to dry the spun para system aramide fiber at a hot roller temperature of 100 to 150° C. for 5 to 20 seconds. If drying temperature is lower than 100° C., it is difficult to remove water, and occurs a problem in handling after winding the fiber onto a tube. If higher than 150° C., it is difficult to dye because the crystallinity is too accelerated.

In the present invention, para system aramide fiber having such properties is served to a dyeing treatment. For the method for dyeing, a particular apparatus and a particular method are not required, and an existing apparatus for dyeing synthetic fibers can be used. The dyeing is achieved by controlling pH by adding an assistant and an acid to a proper amount of dye, starting to dye at, for example, 60° C., elevating the temperature to 130° C. for 60 minutes, and dyeing for 30 minutes. As the dye to be used in a condition of a water content less than 50%, a cation dye, which easily permeates even into a dense structure of fiber, is most desirable.

Para system aramide fiber according to the present invention is useful to various applications. Dyed para system aramide fiber filament can be used as machine cottons, cords, ropes and woven fabrics with various colors. Para system aramide fiber fabrics with various colors obtained by the present invention can be used for clothing for sports, bag texture, working clothes, clothes for fire fighting, and various kinds of protection clothes, tents clothes and other applications. In a texture for bulletproof jacket dyed in an inconspicuous color, even if the outer skin is broken by shot and the para system aramide fiber used as a bulletproof texture is exposed, it is not conspicuous.

Further, as products applied with dyed para system aramide fiber according to the present invention, seat belts for motorcars, protection clothes for speedboat race players, bowstrings, tennis guts, fishing lines and the like can be raised. In a case where dyed para system aramide fiber according to the present invention is used as a reinforcing material of a transparent or semi-transparent resin, it may be produced as a colorful resin product because the colored reinforcing material can be seen through the transparent or semi-transparent resin. For example, such a structure can be employed for a glass frame made from resin, a frame of tennis racket, a hockey stick, a fishing rod, a golf shaft and the like. In a case where the resin is an elastomer, it is useful for a force transmitting resin belt, a resin hose, a bicycle tire and the like. Para system aramide fiber according to the present invention can be applied to ropes or electric wires whose production year is indicated by colors. In a bundle of electric wires, reinforcement of each electric wire and discrimination of a terminal of each electric wire can be both achieved by using reinforcing materials having the respective colors different from each other. It can also be used for a so-called lip cord, in which the fiber is provided under the covering material of the electric wire and the covering material can be cut by using the fiber to expose the wire terminal.

A colored para system aramide fiber staple can be obtained by passing a dyed para system aramide fiber filament through a crimper to provide 4 to 9 crimps/25mm (for example, 6 crimps/inch) similarly to that in commercial para system aramide fibers, and cutting the crimped fiber at a length suitable for spinning, namely, at a length of 20 to 150 mm. The dyed para system aramide fiber can be made as flocks for electrical flocking by cutting it at a length of 1 to 3 mm without crimping. In the present invention, it may be performed that para system aramide fiber before dyeing is crimped and cut, and after making a staple, it is dyed. Similarly, it may be performed that the fiber is dyed after being cut to make flocks for electrical flocking.

EXAMPLES

The present invention will be hereunder explained based on Examples. The following methods for estimating properties in the were employed.

(1) Crystal Size

It is determined by wide angle X-ray diffraction method.

X-ray analysis apparatus: Type 4036A2 produced by Rigaku Denki corporation

X-ray source: CuKα ray curved crystal monochorometer (used with graphite)

(2) Inherent Viscosity

Inherent viscosity (η inh) is determined by a regular method, using a solution in which a polymer is dissolved in a concentrated sulphuric acid with a concentration of 98.5 wt % at a polymer concentration (C) of 0.5 g/dl and at a temperature of 30° C.

$$\eta inh=(ln\cdot\eta rel)/C$$

(3) Tensile strength and Elongation properties of fiber

Tensile strength and tensile modulus elasticity (initial tensile resistance) of fiber are determined according to JIS-L-1013.

(4) Water content

Water content is determined according to JIS-L-1013.

$$\text{Water content } (\%)=(W-W')\times 100/W'$$

Where,

W: mass of a sample at the time when the sample is taken

W': mass of the sample in absolute dry condition (5) L value

L value is determined according to JIS-Z-8729. As the measurement apparatus, Macbeth Color Eyes 3000 produced by Sumika Bunseki Center Corporation is used.

Example 1, Comparative Example 1

Para system aramide fiber A (filamentary yarn), which had a filament number of 1,000 and a total size of 1,500 deniers (converted into absolute dry condition) was produced by dissolving PPTA prepared by a usual method (η inh=6.5) in a concentrated sulphuric acid with a concentration of 99.9% to prepare a dope for spinning having a polymer concentration of 19.0% at a temperature of 80° C., after spinning the dope in air through 1,000 fine holes each having a diameter of 0.06 mm of a die for a moment, introducing the spun dope into water of 4° C. to coagulate it, introducing it into Nelson roller, neutralizing it by 8% sodium hydroxide solution, after washing, drying it by a hot roller for 15 seconds and winding it continuously onto a plastic tube.

Further, dried para system aramide fiber B (filamentary yarn) was produced by introducing the para system aramide fiber A, without winding, into a following hot roller to further heat treat it at a temperature of 350° C. for 10 seconds, and thereafter, winding it.

The properties of these para system aramide fibers are shown in Table 1.

TABLE 1

| Kind of fiber | A | B |
|---|---|---|
| Crystal size (Å) 110 direction | 42 | 65 |
| Tensile strength (g/denier) | 23.0 | 22.2 |
| Tensile modulus elasticity (g/denier) | 565 | 850 |
| Water content (%) | 48 | 2.2 |

These para system aramide fiber filamentary yarns were dyed in a dark blue at the following conditions. The "owf" indicates wt % of a dye relative to fiber weight of a dried fiber. "g/l" indicates weight ratio of an assistant relative to 1 liter of a dyeing bath prepared.

Dyes (cation dyes): "ASTRAZON GOLDEN YELLOW GL"

(C1 YELLOW 28, produced by DYSTER Corporation): 0.1% owf "KAYACRYL RED GL"

(C1 RED 29, produced by Nippon Kayaku Corporation): 2.0% owf

"AIZEN CATHILON BLUE TBLH" (produced by Hodogaya Kagaku Corporation): 8.0 % owf

Assistant: "Neodespon AC" (produced by Mohrin Corporation): 2 g/l

Acetic acid: 1 g/l

Nitric acid sodium: 20 g/l

"Tereal carrier A111" (produced by Meisei Kagaku Corporation): 20 g/l

A sample of the para system aramide fiber was taken by a weight of 10 g as a weight converted into absolute dried condition, it was started to be dyed at a condition of a bath ratio of 1:15 and a temperature of 60° C., the temperature was elevated up to 130° C. for 60 minutes, and it was dyed for 30 minutes. After dyeing, it was served to reduction cleaning in a bath of an anti-ion active agent and a reductant at 80° C. for 20 minutes, and after dehydrated and dried, L value was determined. The smaller the L value is, the smaller the reflection of a light is and the darker the color tone is. In a case of an identical color, the smaller the L value is, the better it is dyed. In the dyeing method using the dyeing bath prepared in the above-described manner, a grade of 50 or less in L value was determined to be well-dyed.

Para system aramide fiber A adsorbed the dye well, but para system aramide fiber B almost was not dyed.

Examples 2 to 4, Comparative Example 2:

Para system aramide fiber A was left at a room temperature to release water, the water content before dyeing was varied, and then it was dyed at the same condition as that of the above-described Example. The fibers were well dyed except in Comparative Example 2 of a water content of 5%.

Comparative Example 3

Para system aramide fiber A was dyed under the aforementioned condition after the water content before dyeing had been controlled at 0% by drying the fiber at 100° C. for 60 minutes using a circulation type hot-air dryer. However, it almost was not dyed.

The results of these Examples and Comparative Examples are shown in Table 2.

TABLE 2

| | Kind of fiber | Water content (%) | L value | Tensile strength (g/denier) | Tensile modulus elasticity (g/denier) |
|---|---|---|---|---|---|
| Comparative Example 1 | B | 2.2 | 65.6 | 22.2 | 830 |
| Example 1 | A | 48 | 45.4 | 23.0 | 565 |
| Example 2 | A | 45 | 45.5 | 23.0 | 565 |
| Example 3 | A | 28 | 45.4 | 23.0 | 565 |
| Example 4 | A | 12 | 46.0 | 23.0 | 565 |
| Comparative Example 2 | A | 5 | 50.2 | 23.0 | 565 |
| Comparative Example 3 | A | 0 | 65.2 | 23.0 | 565 |

Example 5

The yarn of para system aramide fiber A was wound, without adding a twist to the yarn, onto a plastic tube at a tension of 0.04 g/denier, which tube has an inner diameter of 51 mm, an outer diameter of 57 mm and a length of 250 mm length and has many holes each having a diameter of 8 mm on the portion that the yarn is to be wound. The amount of winding was set at 1 kg as a weight in absolute dried condition. It was dyed under the aforementioned condition, using a cheese-dyeing apparatus, in which a dyeing solution was circulated from the holes defined on the plastic tube to the outside of the cheese through the yarn. The water content of the para system aramide fiber before dyeing determined was 48%. Because the para system aramide fiber A slightly released water and its volume decreased accompanying with the elevating temperature during dyeing, gaps were formed between fibers and the dyeing solution was well circulated. L value of the para system aramide fiber A after dyeing was 45.5, and it was well dyed. Tensile strength of the dyed para system aramide fiber was 23.0 g/denier, tensile modulus elasticity was 565 g/denier, and they were satisfactory as properties of a high-strength and high-modulus elasticity para system aramide fiber.

Comparative Example 4

Twists were added to the yarn of para system aramide fiber A by a ring twister at a number of twist of 74/m corresponding to a coefficient of twist=1 defined by the below equation. This twisted yarn was cheese-dyed in the same manner as that of Example 5. Because the filamentary yarn had a circular section by the twisting and a space was formed between yarns at a state wound on a plastic tube, the circulation of the dyeing solution during dyeing was better than that in Example 5. However, partially there occurred an insufficient dyeing portion having a low concentration.

Water in the filament was released by ballooning at the twisting and a centrifugal force exerted on a rotating bobbin, and it was observed that water drops were splashed around the twister. As a result, low-water content portions were formed partially on the para system aramide fiber in its longitudinal direction, and on those portions the dyeing was insufficient.

$$K=(T\sqrt{D})/2870$$

K: coefficient of twist

T: number of twist (number/m)

D: fiber size in absolute dry condition (denier)

Thus, according to the present invention, a polyparaphenylene terephthalamide fiber, which can be dyed while its properties of high strength and high modulus elasticity are maintained, and a polyparaphenylene terephthalamide fiber dyed in a variety of colors, can be provided.

INDUSTRIAL APPLICATIONS OF THE INVENTION

In the present invention, a polyparaphenylene terephthalamide fiber, which can be dyed while its properties of high strength and high modulus elasticity are maintained, and a polyparaphenylene terephthalamide fiber dyed in a variety of colors, can be provided. The para system aramide fiber according to the present invention is suitable for various applications, especially the dyed para system aramide fiber filament can be used as machine cottons, cords, ropes and textiles with various colors. Para system aramide fiber textile with various colors according to the present invention can be used as clothing for sports, bag texture, working clothes, clothes for fire fighting, and various kinds of protection clothes, tents clothes and other applications.

What is claimed is:

1. A dyeable polyparaphenylene terephthalamide fiber which has been wound once after spinning and has not been dyed yet, characterized in that said fiber has a tensile strength of 15 g/denier or more and a crystal size (110 direction) of 30 to 55 angstroms and has no history of a drying treatment to have a water content of 8% to 49%.

2. The dyeable polyparaphenylene terephthalamide fiber according to claim 1, wherein said fiber has no history of a treatment drying to have a water content of 15% or less.

3. A staple type of dyeable polyparaphenylene terephthalamide fiber, wherein the fiber according to claim 1 or 2 is treated to be provided with 4 to 9 crimps/25 mm, and cut at a fiber length of 20 to 150 mm.

4. A flock type of dyeable polyparaphenylene terephthalamide fiber, wherein the fiber according to claim 1 or 2 is cut at a length of 0.1 to 3 mm.

5. A dyed polyparaphenylene terephthalamide fiber, wherein the fiber according to claim 1 or 2 is dyed.

6. The dyed polyparaphenylene terephthalamide fiber according to claim 5, wherein said fiber is dyed by a cation dye.

7. A staple type of dyed polyparaphenylene terephthalamide fiber, wherein the staple type of polyparaphenylene terephthalamide fiber according to claim 3 is dyed.

8. The staple type of dyed polyparaphenylene terephthalamide fiber according to claim 7, wherein said fiber is dyed by a cation dye.

9. A flock type of dyed polyparaphenylene terephthalamide fiber, wherein the flock type of polyparaphenylene terephthalamide fiber according to claim 4 is dyed.

10. The flock type of dyed polyparaphenylene terephthalamide fiber according to claim 9, wherein said fiber is dyed by a cation dye.

* * * * *

UNITED STATES PATENT AND TRADEMARK OFFICE

CERTIFICATE OF CORRECTION

PATENT NO. : 6,348,263 B1
DATED : February 19, 2002
INVENTOR(S) : Hatano et al.

It is certified that error appears in the above-identified patent and that said Letters Patent is hereby corrected as shown below:

Column 4,
Line 30, after "8" please insert -- % --

Signed and Sealed this

Fourth Day of June, 2002

*Attest:*

*Attesting Officer*

JAMES E. ROGAN
*Director of the United States Patent and Trademark Office*